US006085444A

United States Patent [19]

Cho

[11] Patent Number: 6,085,444

[45] Date of Patent: Jul. 11, 2000

[54] VENTILATED FOOTWEAR

[76] Inventor: Nam Suk Cho, 304-1002. Expo Apt., 464-1 Chumin-Dong, Yusung-ku, Daejun, Rep. of Korea

[21] Appl. No.: 09/197,102

[22] Filed: Nov. 20, 1998

[30] Foreign Application Priority Data

Nov. 21, 1997 [KR] Rep. of Korea ..... 97-33342 U

[51] Int. Cl.[7] ..... A43B 7/06

[52] U.S. Cl. ..... 36/3 B; 36/3 R

[58] Field of Search ..... 36/3 R, 3 B, 29, 36/153

[56] References Cited

U.S. PATENT DOCUMENTS

| | | | |
|---|---|---|---|
| 4,073,072 | 2/1978 | Gross et al. | 36/44 |
| 4,617,745 | 10/1986 | Batra | 36/3 B |
| 4,860,463 | 8/1989 | Pin | 36/3 B |
| 5,010,661 | 4/1991 | Chu | 36/3 B |
| 5,179,792 | 1/1993 | Brantingham | 36/3 B X |
| 5,477,626 | 12/1995 | Kwon | 36/3 B |
| 5,606,806 | 3/1997 | O'Dwyer | 36/3 B |
| 5,697,170 | 12/1997 | Murrell et al. | 36/3 B |
| 5,746,013 | 5/1998 | Fay, Sr. | 36/3 R |
| 5,813,140 | 9/1998 | Obeid | 36/3 B X |
| 5,826,349 | 10/1998 | Goss | 36/3 B X |

*Primary Examiner*—M. D. Patterson
*Attorney, Agent, or Firm*—Merchant & Gould P.C.

[57] ABSTRACT

Provided is a ventilated footwear including first, second and third air pressing rooms 3, 4 and 5 in a bottom formulation 2, 2' in an approximate triangle shape organically for enhancing comfort of a wearer of the footwear, in which a ball unit 24, having a donut-type void, formed on the center of each of the first, second and third air pressing rooms 3, 4 and 5, so dramatically decreasing impact exerted on a foot when the wearer of the footwear walks or runs as well as smoothly circulating outside air into the footwear 1, 1' for preventing eczema.

6 Claims, 4 Drawing Sheets

VENTILATED FOOTWEAR

BACKGROUND OF THE INVENTION

1. Technical Field

The present invention is related to a ventilated footwear, and more particularly to a ventilated footwear which has a plurality of air pressing rooms interconnected on the insole of the footwear such as an athletic shoe, shoes or the like for letting air into the air pressing rooms from outside the footwear, resulting in serving convenience to user's foot.

2. Description of the Prior Art

In general, athletic shoes are daily necessities for humans acting to shield the foot. But in some cases, the foot is very sensitive to the footwear.

The athletic shoes (hereinafter, referred to footwear) includes an upper shielding portion for surrounding the instep, and a lower shielding portion for supporting the sole of the foot. The lower shielding portion is made by an injection-molding machine.

On the surface of the lower shielding portion, treads having various shapes are formed in a constant depth for preventing slipping on the ground.

However, when a size of the footwear does not fit the foot of a wearer, the wearer feels pain on his foot. Generally, as the wearer is heavier, the wearer feels more pain on his foot. Additionally, when the wearer walks a long time or runs, the wearer may be adversely affected by that, so increasing fatigue.

SUMMARY OF THE INVENTION

The present invention has been made to overcome the above described problems of the prior art. It is an object of the present invention to provide a ventilated footwear for decreasing impact on the foot caused by walking or running of a wearer as well as for circulating fresh air smoothly in the footwear.

To achieve the above object, the present invention provides a ventilated footwear comprising an upper shielding means for surrounding an instep; a lower shielding means formed under the upper shielding means for supporting a sole of the foot; an air suction means formed in a side of the lower shielding means for inhaling air in one direction from outside; a sucked air storing means connected to the air suction means for storing the inhaled air in the lower shielding means; and an exhaust means connected to the sucked air storing means for, when an interior pressure is larger than a predetermined level, transmitting the air stored in the sucked air storing means to a toe portion of the lower shielding means by way of the interior pressure, and exhausting the air through an upper surface of the lower shielding means.

The sucked air storing means comprises a first air pressing room 3, a second air pressing room 4, and a third air pressing room 5 in the lower shielding means in shape of an approximate triangle for physically absorbing impact; and the air suction means comprises suction pipes 6, 6' formed in the lower shielding means for inhaling outside air into the first and second air pressing room 3, 4; and connection pipes 9, 9' formed between the first air pressing room 3 and the second air pressing room 4 and between the second air pressing room 4 and the third air pressing room 5 for transmitting the air, induced through each of the suction pipes, to each of the adjacent pressing rooms.

In the ventilating footwear, check valves 8, 8' are mounted on rear ends of the suction pipes 6, 6' for transmitting outside air toward the first and second air pressing rooms.

In the ventilated footwear, check valves 8", 8'" are mounted on ends of the connection pipes 9, 9' for transmitting the sucked air from the second air pressing room 4 to the first air pressing room 3 and from the first air pressing room 3 to the third air pressing room 5.

Ball units 24 are formed on the center of the first, second and third air pressing rooms 3, 4 and 5, an I-type pillar 26 is integrally formed on the center of each of the ball unit 24, a donut-type void 25 is formed on circumference of the I-type pillar 26, and a check valve 8"" is mounted at a portion of the void 25.

The exhaust means comprises an exhaust pipe 10 connected to the sucked air storing means; extension pipes 12 extending laterally at the end of the exhaust pipe for supplying air to toes, and each having a breathing hole 11 on an upper surface in a regular space; and an air controlling valve 13 mounted at an end of the exhaust pipe 10.

The air controlling valve 13 comprises a flange valve 15 having an arrow-shaped head 14 on the end thereof for flowing air from the sucked air storing means through the exhaust pipe; a coil spring 16 interposed on a circumference of the flange valve 15; a spring holder 17 cylindrically formed for being interposed in a rear end of the flange valve 15, the spring holder having a screw 18 on a circumference thereof; and an adjust gear 19 mounted on the screw 18 of the spring holder 17 in a gear engagement through a portion of the exhaust pipe 10.

In another mode of the present invention, a ventilated footwear comprises an upper shielding unit for surrounding an instep; a lower shielding unit formed under the upper shielding means for surrounding a sole of the foot; a first air room 28 formed in a rear portion of the lower shielding unit; a second air room 29 formed in a front portion of the lower shielding unit being adjacent to the first air room 28; an entrance 30 formed at a rear end of the first air room 28 for inhaling outside air at a heel portion; an exit 31 formed at a front end of the first air room 28 for exhausting air from the first air room 28 into the second air room; check valves 32, 32' mounted to the entrance 30 and the exit 31 for flowing air in one direction; and a plurality of breathing holes 11' formed on an upper surface of the second air room 29.

BRIEF DESCRIPTION OF THE DRAWINGS

The above objects and other advantages of the present invention will become more apparent by describing in detail the preferred embodiment thereof with reference to the attached drawings, in which.

DETAILED DESCRIPTION OF THE PREFERRED EMBODIMENT

Figure 1:
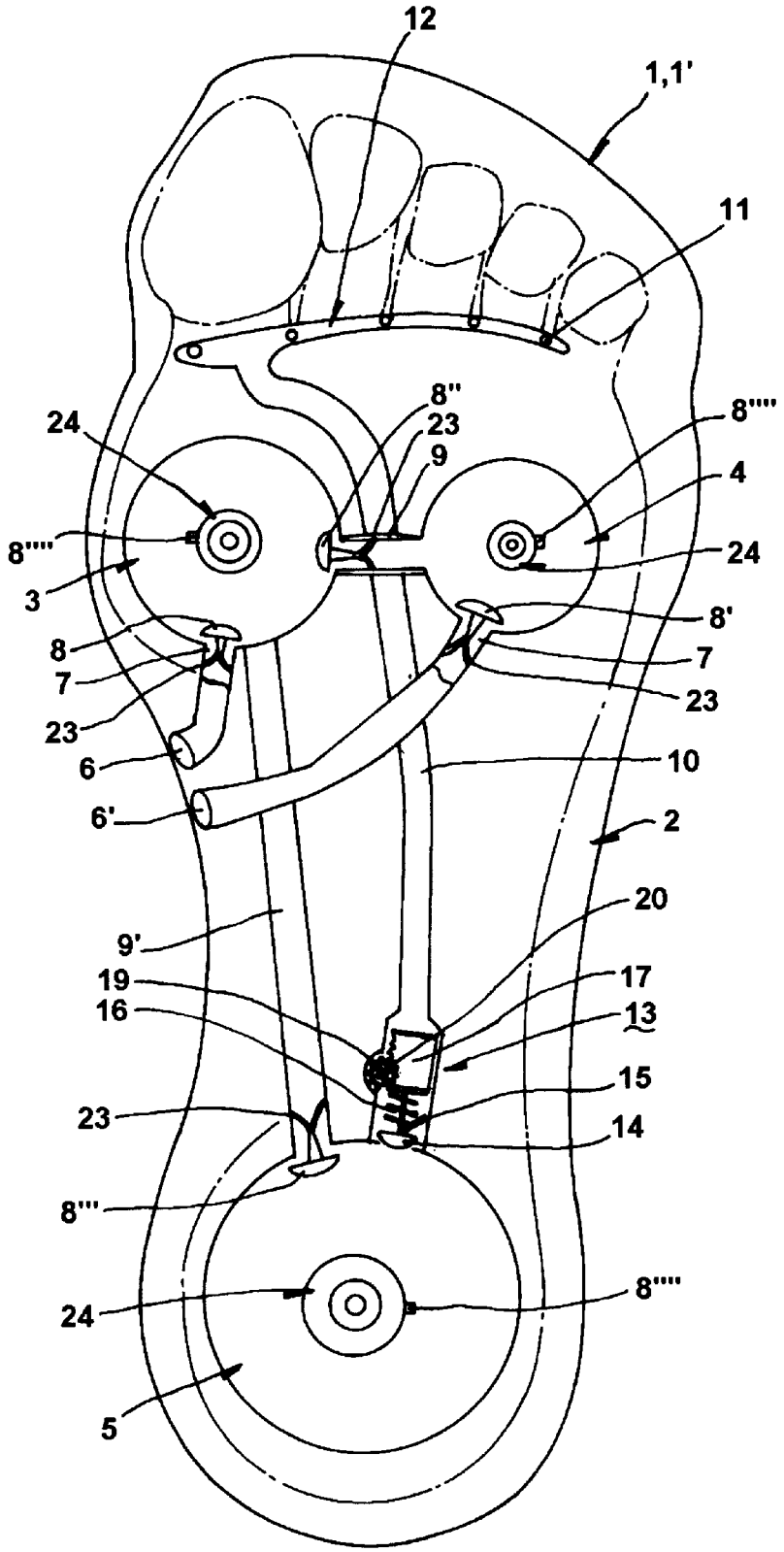
FIG. 1 is a plane view showing inside of ventilated footwear according to the present invention schematically.
Figure 2:
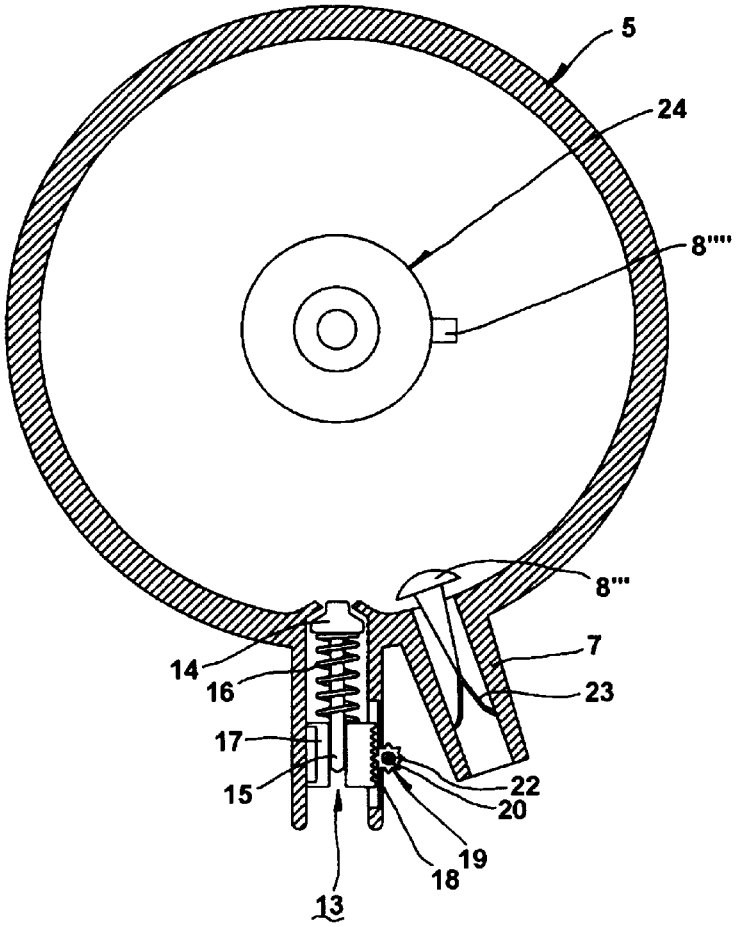
FIG. 2 is an enlarged cross-sectional view showing an air pressing room of FIG. 1.
Figure 3:
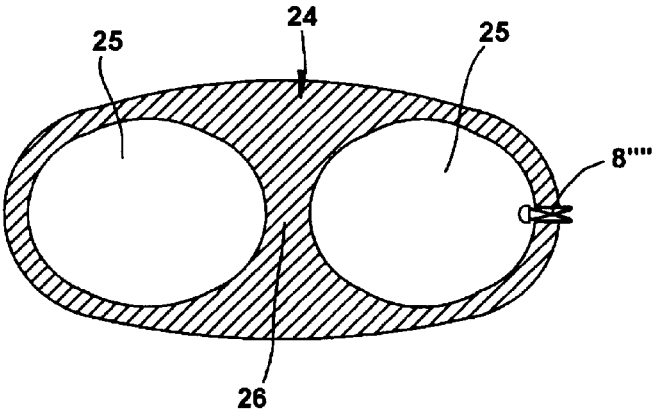
FIG. 3 is an enlarged vertical-sectional view showing a ball unit having donut-type void which constitutes the air pressing room of FIG. 2.
Figure 4:
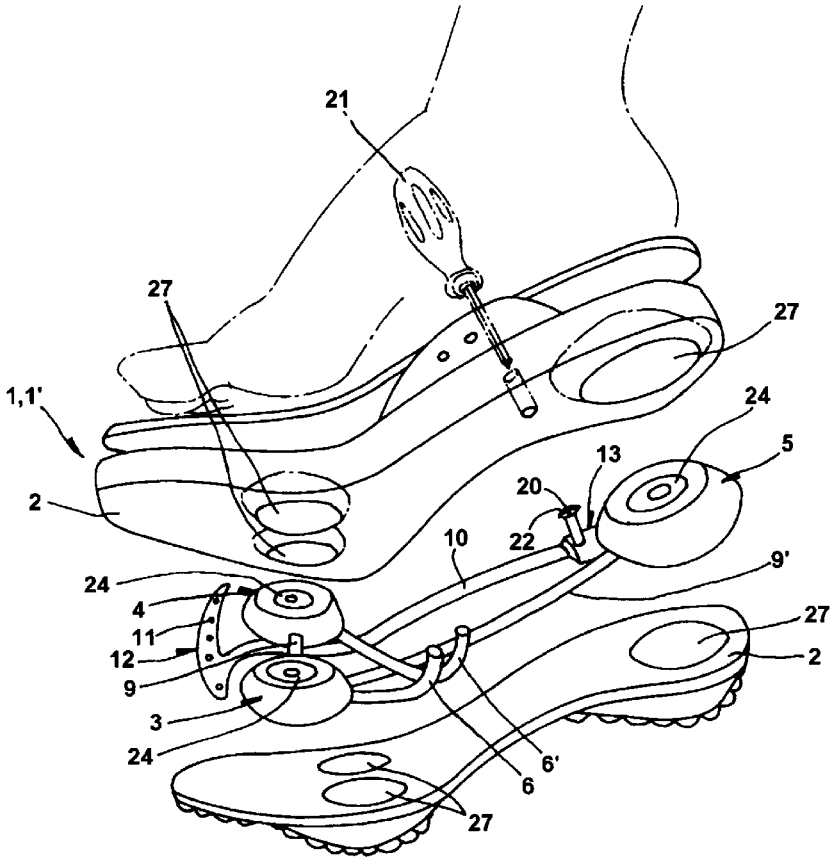
FIG. 4 is an exploded perspective view showing the ventilated footwear of FIG. 1.

Hereinafter, ventilated footwear according to a preferred embodiment of the present invention is described referring to the accompanying drawings.

As shown in FIGS. 1 to 4, first, second and third air pressing rooms 3, 4 and 5 are formed on a bottom formation 2. The bottom formation 2 protects a lower portion of the footwear such as an athletic shoe 1 or shoes 1' for preventing any impact from being exerted on foot of a person wearing the athletic shoe 1 or the shoes 1', and giving convenient feeling to the wearer. The first, second and third air pressing rooms 3, 4 and 5, serving for storing an inlet air, are in a triangle form.

At this time, the first air pressing room 3 and the second air pressing room are provided with suction pipes 6, 6' for inhaling air from outside respectively. One-directional check valves 8, 8' are mounted on an end portion 7 of each of the suction pipes 6, 6'. The one-direction check valves 8, 8' allow an exterior air flowing in, and prevent an interior air from flowing out.

A connection pipe 9 is provided so that the air, inlet through the suction pipe 6' into the second air pressing room 4, can stream into the first air pressing room 3. Another check valve 8" is mounted on the end 7 of the connection pipe 9 toward the first air pressing room 3. Another connection pipe 9' is provided for flowing air from the first air pressing room 3 into the third air pressing room 5. Check valve 8'" is also mounted on the end 7 of the connection pipe 9' toward the third air pressing room 5.

An exhaust pipe 10 is provided to a portion on the circumference of the third air pressing room 5, for flowing air from the third air pressing room 5 toward the toes. An extension pipe 12 is provided on an end of the exhaust pipe 10. The extension pipe 12 includes breathing holes 11 at regular intervals. An air control valve 13 is mounted on the end 7 of the exhaust pipe 10 of the third air pressing room 5. The air controlling valve 13 allows air flowing through the exhaust valve 10 to each toe only when air pressure exceeds a predetermined level.

The air control valve 13 includes a flange valve 15 having an arrow-shaped head 14 for blocking air from flowing through the exhaust pipe 10; a coil spring 16 for opening/closing the flange valve 15 according to the air pressure generated by inner pressure of the third air pressing room 5; a cylindrical spring holder 17 interposed in a rear end of the flange valve 15 for controlling elasticity of the coil spring 16; a screw 18 formed on the circumference of the spring holder 17; and an adjust gear 19 mounted on the screw 18 of the spring holder 17 in a gear engagement on a portion of the exhaust pipe 10 for controlling elasticity of the coil spring 16 by moving the spring holder 17.

At this time, the adjust gear 19 has an adjust gear screw 20 which extrudes vertically. On the top of the adjust gear screw 20, a cross recess 22 is formed so that the screw can be adjusted by a driver 21.

A rubber string 23 is integrally formed on an end of each of the check valves 8, 8' of the suction pipe 6, 6' and the check valves 8", 8'" of the connection pipe 9, 9'. The rubber pipe is fixed to an interior wall of the suction pipe.

A ball unit 24 is formed on the center of the first, second and third air pressing room 3, 4 and 5 for preventing any impact from being exerted to the sole of a foot when walking or running. Inside of the ball unit 24, a void 25 is formed as a donut-type. A I-type support pillar 26 is formed on a center of the ball unit. A check valve 8"" is mounted on a portion of each of the void for inhaling air.

The bottom formation of the footwear 1, 1' includes install recesses 27 for installing the first, second and third air pressing room 3, 4 and 5, the suction pipes 6, 6', the connection pipes 9, 9', and the exhaust pipe 10.

Figure 5:
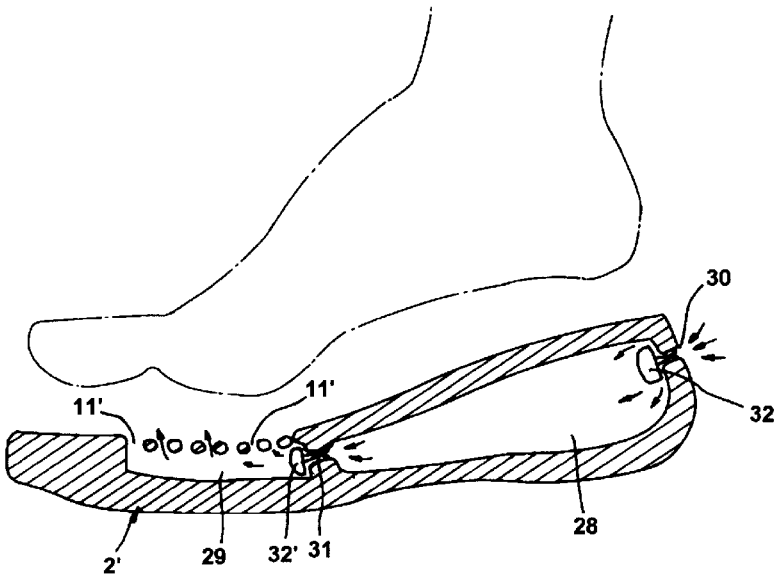
FIG. 5 is a cross sectional view of a ventilated footwear according to another embodiment of the present invention.
Figure 6:
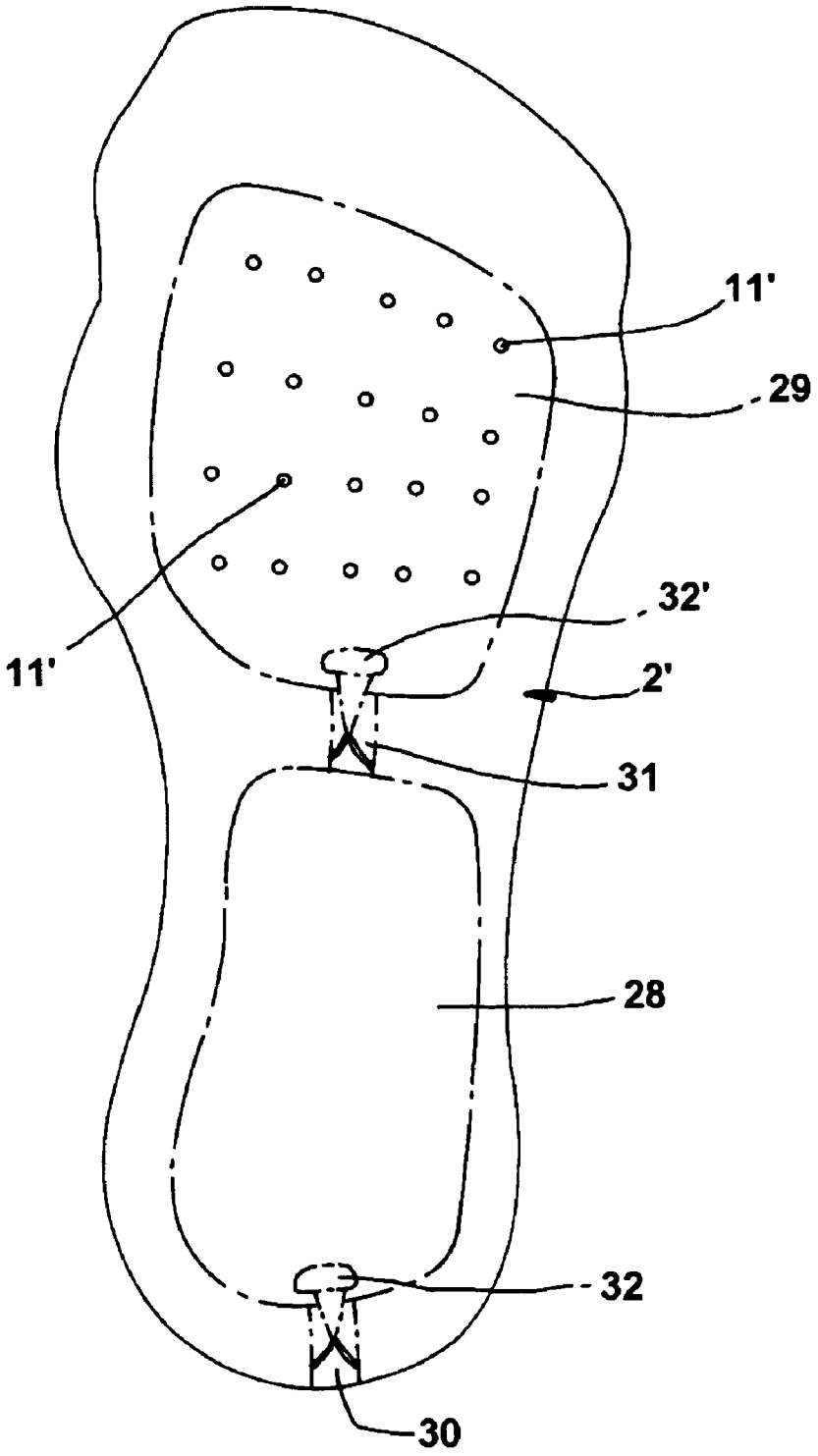
FIG. 6 is a plane view showing the ventilated footwear of FIG. 5.

Another embodiment is now explained referring to FIGS. 5 and 6. As shown in the figures, a bottom formation 2' may divide the sole of the footwear in two portions and include a first air room 28 in a rear portion and a second air room 29 in a front portion for preventing any impact from being exerted to a foot of the wearer and for supplying air to the toes so preventing eczema and so on.

At this time, check valves 32, 32' are respectively mounted on an entrance 30 and exit 31, formed at front and rear ends of the first air room 28, for exhausting air, induced from outside, into the second air room 29 from a heel portion of the footwear to toes. A plurality of breathing holes 11' are formed on an upper of the second air room 29 for flowing air among the toes of the wearer. The breathing holes 11' are preferably arranged in every direction in series within a sufficient area for air to widely be supplied to the toes of the wearer.

Now, operation of the present invention constructed as above is explained below.

When a wearer of the footwear made by the present invention walks or runs, an impact is exerted by a weight of the wearer on the first, second and third air pressing rooms 3, 4 and 5 of the bottom formulation 2 of the footwear 1, 1' which are arranged in an approximate triangle. At this time, the I-type pillar 26 of the ball unit 24, which is installed on the center of the first, second and third air pressing rooms 3, 4 and 5, is pressed together with the donut-type void 25, which is formed on the circumference of the pillar continuously, so acting as a shock absorber. Then, when the interior pressure of the first, second and third air pressing room 3, 4 and 5 is larger than a predetermined level, air can be sucked into each of the voids 25 through the check valve 8"", installed on the circumference of each of the voids 25.

In addition, because of a negative pressure generated by expanding the first, second and third air pressing rooms 3, 4 and 5 when taking off the footwear from a foothold such the earth or ground, the check valves 8, 8', which are installed on each of the end of the first and second air pressing rooms 3, 4 toward the suction pipes 6, 6', are opened such that the air is induced from outside. The air, induced into the first air pressing room 3, and the air, additionally induced into the first air pressing room 3 through the check valve 8" toward the connection pipe 9 of the second air pressing room 4, is induced into the third air pressing room 5 through the check valve 8'" of the connection pipe 9' which is in a long bridge connection thereto.

At this time, if the air pressure of the third air pressing room 5 increases, the air controlling valve 13 of the exhaust pipe 10, connected to an end of the third air pressing room 5, is opened by the interior pressure such that the inside air can be exhausted through the exhaust pipe 10. The exhausted air can be leaked out to the toes through the breathing holes 11 of the lateral extension pipe 12, which is connected to the exhaust pipe 10. Therefore, any moisture, generated on the toes of the wearer, can be smoothly eliminated.

In special, the interior pressure, exerted to the third air pressing room 5, pushes the arrow-shaped head 14 of the flange valve 15, consisting the air controlling valve 13, so that the air controlling valve 13 pushes the coil spring 16 interposed in the circumference of the flange valve 15. Then, when the interior pressure of the third air pressing room 5 decreases, the air controlling valve 13 makes the flange valve 15 restored to the original state. Further, the adjust gear 19 is tooth-engaged with the screw 18 of the spring holder 17 which is interposed on the rear of the flange valve

15 for supporting the coil spring 16. The spring holder 17 can be moved by turning and controlling the cross recess 22 on the adjust gear screw 20 of the adjust gear 19, so controlling the elasticity of the coil spring 16.

In another embodiment, when a wearer of the footwear 1, 1' steps forward, the weight of the wearer presses the first air room 28 of the sole formulation of the footwear 1, 1'. Then, the check valve 32' connected to the second air room 29 in the front portion is opened, exhausting air exerted by the interior pressure through each of the breathing holes 11' of the second air room 29 to the toes. After that, when taking off the foot, a negative pressure is generated inside of the first air room 28, so inducing air therein through the check valve 32 at the rear of the first air room 28. That is, when the wearer walks or runs, the outside air can be repeatedly circulated through the first air room 28 into the second air room 29.

What is claimed is:

1. A ventilating footwear comprising, an upper shielding means for surrounding an instep;

a lower shielding means formed under the upper shielding means for supporting a sole of the foot;

an air suction means formed in a side of the lower shielding means for inhaling air in one direction from outside;

a sucked air storing means connected to the air suction means for storing the inhaled air in the lower shielding means; and an exhaust means connected to the sucked air storing means for, when an interior pressure is larger than a predetermined level, transmitting the air, stored in the sucked air storing means, to a toe portion of the lower shielding means by way of the interior pressure, and exhausting the air through an upper surface of the lower shielding means;

wherein the sucked air storing means comprises a first air pressing room, a second air pressing room, and a third air pressing room in the lower shielding means in shape of an approximate triangle for physically absorbing impact; and wherein the air suction means comprises, suction pipes formed in the lower shielding means for inhaling outside air into the first and second air pressing room; and connection pipes formed between the first air pressing room and the second air pressing room and between the second air pressing room and the third air pressing room for transmitting the air, induced through each of the suction pipes, to each of the adjacent pressing rooms.

2. The ventilating footwear as claimed in claim 1, wherein check valves are mounted on rear ends of the suction pipes for transmitting outside air toward the first and second air pressing rooms.

3. The ventilating footwear as claimed in claim 1, wherein check valves are mounted on ends of the connection pipes for transmitting the sucked air from the second air pressing room to the first air pressing room and from the first air pressing room to the third air pressing room.

4. The ventilating footwear as claimed in claim 1, wherein ball units are formed on the center of the first, second and third air pressing rooms, an I-type pillar is integrally formed on the center of each of the ball unit, a donut-type void is formed on circumference of the I-type pillar, and a check valve is mounted at a portion of the void.

5. The ventilating footwear as claimed in claim 1, wherein the exhaust means comprises, an exhaust pipe connected to the sucked air storing means;

extension pipes extending laterally at the end of the exhaust pipe for supplying air to toes, and each having breathing hole on an upper surface in a regular space; and an air controlling valve mounted at an end of the exhaust pipe.

6. The ventilating footwear as claimed in claim 5, wherein the air controlling valve comprises, a flange valve having an arrow-shaped head on the end thereof for flowing air from the sucked air storing means through the exhaust pipe;

a coil spring interposed on a circumference of the flange valve;

a spring holder cylindrically formed for being interposed in a rear end of the flange valve, the spring holder having a screw on a circumference thereof; and an adjust gear mounted on the screw of the spring holder in a gear engagement through a portion of the exhaust pipe.

* * * * *